US008238521B2

(12) United States Patent
McKim et al.

(10) Patent No.: US 8,238,521 B2
(45) Date of Patent: Aug. 7, 2012

(54) X-RAY COLLIMATORS, AND RELATED SYSTEMS AND METHODS INVOLVING SUCH COLLIMATORS

(75) Inventors: Royce McKim, Austin, TX (US); Rodney H. Warner, Austin, TX (US)

(73) Assignee: United Technologies Corp., Hartford, CT (US)

( * ) Notice: Subject to any disclaimer, the term of this patent is extended or adjusted under 35 U.S.C. 154(b) by 309 days.

(21) Appl. No.: 12/661,674

(22) Filed: Mar. 22, 2010

(65) Prior Publication Data

US 2010/0202591 A1 Aug. 12, 2010

Related U.S. Application Data

(63) Continuation-in-part of application No. 12/043,371, filed on Mar. 6, 2008, now abandoned.

(51) Int. Cl.
*G21K 1/02* (2006.01)

(52) U.S. Cl. ..... 378/149

(58) Field of Classification Search ..... 378/147, 378/149

See application file for complete search history.

(56) References Cited

U.S. PATENT DOCUMENTS

| | | | |
|---|---|---|---|
| 2,731,710 | A | 4/1956 | Bartow et al. |
| 4,054,800 | A | 10/1977 | Leask |
| 4,118,632 | A | 10/1978 | Luig |
| 4,211,927 | A | 7/1980 | Hellstrom et al. |
| 4,242,587 | A | 12/1980 | Lescrenier |
| 4,453,226 | A | 6/1984 | Hobbs et al. |
| 4,521,372 | A | 6/1985 | Price et al. |
| 4,558,458 | A | 12/1985 | Katsumata et al. |
| 4,590,658 | A | 5/1986 | Funyu et al. |
| 4,599,740 | A | 7/1986 | Cable |
| 4,636,475 | A | 1/1987 | Price et al. |
| 4,691,332 | A | 9/1987 | Burstein et al. |
| 4,821,511 | A | 4/1989 | Felix et al. |
| 4,828,454 | A | 5/1989 | Morris et al. |
| 4,969,110 | A | 11/1990 | Little et al. |
| 4,989,225 | A | 1/1991 | Gupta et al. |
| 5,119,408 | A | 6/1992 | Little et al. |
| 5,131,021 | A | 7/1992 | Gard et al. |
| 5,140,661 | A | 8/1992 | Kerek |
| 5,222,114 | A | 6/1993 | Kamata et al. |
| 5,430,298 | A | 7/1995 | Possin et al. |
| 5,442,179 | A | 8/1995 | Ohishi |
| 5,550,378 | A | 8/1996 | Skillicorn et al. |
| 5,555,283 | A | 9/1996 | Shiu et al. |
| 5,652,429 | A | 7/1997 | Genna |

(Continued)

FOREIGN PATENT DOCUMENTS

JP 60256034 12/1985

(Continued)

OTHER PUBLICATIONS

"Scientific Papers", Molecular Imaging and Biology, vol. 8, No. 2, Mar. 1, 2006, pp. 49-123.

(Continued)

*Primary Examiner* — Jurie Yun

(57) ABSTRACT

X-ray collimators, and related systems and methods involving such collimators are provided. In this regard, a representative X-ray collimator includes: a first member having channels located on a surface thereof; and a second member having protrusions located on a surface thereof; the first member and the second member being oriented such that the protrusions extend into the channels to define collimator apertures, each of the collimator apertures being defined by a portion of the first member and a portion of the second member.

14 Claims, 6 Drawing Sheets

U.S. PATENT DOCUMENTS

| | | | |
|---|---|---|---|
| 5,799,057 | A | 8/1998 | Hoffman et al. |
| 5,889,834 | A | 3/1999 | Vilsmeier et al. |
| 5,930,326 | A | 7/1999 | Rothschild et al. |
| 5,982,846 | A | 11/1999 | Toth et al. |
| 5,991,357 | A | 11/1999 | Marcovici et al. |
| 6,041,132 | A | 3/2000 | Isaacs et al. |
| 6,104,776 | A | 8/2000 | Oikawa |
| 6,167,110 | A | 12/2000 | Possin et al. |
| 6,188,748 | B1 | 2/2001 | Pastyr et al. |
| 6,229,872 | B1 | 5/2001 | Amos |
| 6,438,210 | B1 | 8/2002 | Castleberry |
| 6,457,862 | B1 | 10/2002 | Sumii et al. |
| 6,487,267 | B1 | 11/2002 | Wolter |
| 6,639,964 | B2 | 10/2003 | Schneider et al. |
| 6,671,541 | B2 | 12/2003 | Bishop et al. |
| 6,703,622 | B2 | 3/2004 | Joubert |
| 6,868,138 | B2 | 3/2005 | Clinthorne et al. |
| 6,879,715 | B2 | 4/2005 | Edic et al. |
| 6,925,140 | B2 | 8/2005 | Bruder |
| 6,934,642 | B2 | 8/2005 | Berry et al. |
| 6,979,826 | B2 | 12/2005 | Ikhlef |
| 7,016,458 | B2 | 3/2006 | Francke |
| 7,095,028 | B2 | 8/2006 | Mollov et al. |
| 7,099,435 | B2 | 8/2006 | Heumann et al. |
| 7,115,876 | B2 | 10/2006 | Ren et al. |
| 7,120,282 | B2 | 10/2006 | Langan |
| 7,133,491 | B2 | 11/2006 | Bernardi et al. |
| 7,177,388 | B2 | 2/2007 | Takagi et al. |
| 7,185,662 | B2 | 3/2007 | Succop |
| 7,187,800 | B2 | 3/2007 | Hibbard |
| 7,188,998 | B2 | 3/2007 | Gregerson et al. |
| 7,204,019 | B2 | 4/2007 | Ducotey et al. |
| 7,216,694 | B2 | 5/2007 | Otero et al. |
| 7,221,737 | B2 | 5/2007 | Hoheisel et al. |
| 7,236,564 | B2 | 6/2007 | Hopkins et al. |
| 7,254,209 | B2 | 8/2007 | Zhao et al. |
| 7,254,211 | B2 | 8/2007 | Hunt et al. |
| 7,272,207 | B1 | 9/2007 | Aufrichtig et al. |
| 7,283,605 | B2 | 10/2007 | Sainath et al. |
| 7,283,608 | B2 | 10/2007 | Hoffman |
| 7,283,616 | B2 | 10/2007 | Freund et al. |
| 7,286,630 | B2 | 10/2007 | Holt |
| 7,286,636 | B2 | 10/2007 | Unger et al. |
| 7,341,376 | B2 | 3/2008 | Birdwell |
| 2001/0040219 | A1 | 11/2001 | Cherry et al. |
| 2002/0097836 | A1 | 7/2002 | Grodzins |
| 2006/0133545 | A1 | 6/2006 | Takagi et al. |
| 2007/0064878 | A1 | 3/2007 | Heismann |
| 2008/0075227 | A1 | 3/2008 | Christoph et al. |
| 2008/0298546 | A1 | 12/2008 | Bueno et al. |
| 2009/0225954 | A1 | 9/2009 | McKim et al. |

FOREIGN PATENT DOCUMENTS

| | | |
|---|---|---|
| JP | 05409088 | 11/1993 |
| JP | 06237927 | 8/1994 |
| JP | 08187239 | 7/1996 |

OTHER PUBLICATIONS

Sun et al. "X-Ray Micocomputed Tomography for Measuring Polymerization Shrinkage of Polymeric Dental Composites", Dental Maerials, vol. 24, No. 2, Dec. 26, 2007, pp. 228-234.

Johnson et al. "Virtual Histology of Transgenic Mouse Embryos for High-Throughput Phenotyping", PLOS Genetices, vol. 2, No. 4, Apr. 2006, pp. 471-477.

Dufresne, T. "Segmentation Techniques for Analysis of Bone by Three-Dimensional Computed Tomographic Imaging", Technology and Health Care, vol. 6, No. 5/06, Dec. 1, 1998, pp. 351-359.

Kai Wang et al. "Surface Detection With Subvoxel Accuracy Using Facet Model and IDDG Operator", Computer-Aided Industrial Design and Conceptual Design, 2006, Nov. 17, 2006, pp. 1-5.

Andrew Burghardt et al. "A Local Adaptive Threshold Strategy for High Resolution Peripheral Quantitative Computer Tomography of Trabecular Cone", Annals of Biomedical Engineering, vol. 35, No. 10, Jun. 30, 2007, pp. 1678-1686.

Oh W et al. "Image Thresholding by Indicator Kriging", IEE Transactions on Pattern Analysis and Machine Intelligence, vol. 21, No. 7, Jul. 1, 1999, pp. 590-602.

EP Search Report for EP2369595 dated Mar. 15, 2012.

X-RAY COLLIMATORS, AND RELATED SYSTEMS AND METHODS INVOLVING SUCH COLLIMATORS

CLAIM OF PRIORITY

This patent application is a continuation-in-part of, and claims priority from U.S. application Ser. No. 12/043,371 filed on Mar. 6, 2008, which is incorporated by reference in its entirety.

BACKGROUND

1. Technical Field

The disclosure generally relates to non-destructive inspection of components.

2. Description of the Related Art

Computed tomography (CT) involves the use of X-rays that are passed through a target. Based on the amount of X-ray energy detected at a detector located downstream of the target, information about the target can be calculated. By way of example, representations of target shape and density in three dimensions can be determined.

SUMMARY

X-ray collimators, and related systems and methods involving such collimators are provided. In this regard, an exemplary embodiment of an X-ray collimator comprises: a first member having channels located on a surface thereof; and a second member having protrusions located on a surface thereof; the first member and the second member being oriented such that the protrusions extend into the channels to define collimator apertures, each of the collimator apertures being defined by a portion of the first member and a portion of the second member.

An exemplary embodiment of an X-ray system comprises: an X-ray source; and an X-ray collimator having a first member and a second member, the first member having channels located on a surface thereof, the second member having protrusions located on a surface thereof, the first member and the second member being oriented such that the protrusions extend into the channels to define collimator apertures, each of the collimator apertures being defined by a portion of the first member and a portion of the second member, each of the collimator apertures being aligned with the X-ray source.

An exemplary embodiment of a method involving an X-ray collimator comprises: providing a first member having channels located on a surface thereof; providing a second member having protrusions located on a surface thereof; and orienting the first member and the second member such that the protrusions extend into the channels to define X-ray collimator apertures.

According to another aspect of the invention, an X-ray collimator is provided that includes a first collimator section, a second collimator section and a plurality of collimator apertures. The first collimator section includes a plurality of passages, each passage extending between first and second surfaces. The second collimator section includes a longitudinal passage extending between first and second surfaces. Each collimator aperture is respectively defined in a first direction between the first and the second surfaces of a respective one of the passages in the first collimator section. Each collimator aperture is respectively defined in a second direction between the first and the second surfaces of the passage in the second collimator section.

According to another aspect of the invention, an X-ray collimator is provided that includes a first member, a second member and a plurality of collimator apertures. The first member includes first and second collimator sections. The first collimator section includes a plurality of channels, each channel having a first channel sidewall. The second collimator section includes a surface. The second member is mated with the first member, and includes first and second collimator sections. The first collimator section includes a plurality of protrusions respectively extending into the channels, each protrusion having a first protrusion sidewall. The second collimator section includes a surface. Each collimator aperture is respectively defined in a first direction between one of the first channel sidewalls and one of the first protrusion sidewalls. Each collimator aperture is defined in a second direction between the second collimator section surfaces of the first and the second members.

According to another aspect of the invention, an X-ray system is provided that includes an X-ray source and an X-ray collimator. The X-ray collimator includes a first collimator section, a second collimator section and a plurality of collimator apertures. The first collimator section includes a plurality of passages, each passage extending between first and second surfaces. The second collimator section includes a longitudinal passage extending between first and second surfaces. Each collimator aperture is respectively defined in a first direction between the first and the second surfaces of a respective one of the passages in the first collimator section. Each collimator aperture is respectively defined in a second direction between the first and the second surfaces of the passage in the second collimator section.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

X-ray collimators, and related systems and methods involving such collimators are provided, several exemplary embodiments of which will be described in detail. In this regard, collimators can be used, for example, in X-ray systems that are configured to perform non-destructive inspection of components. In such a system, X-rays are passed through a component and attenuation of the X-rays is measured by a set of detectors. A collimator is located upstream of the detectors to reduce the number of unwanted (e.g., scattered) X-rays reaching the detectors that can result in inaccurate measurements of X-ray attenuation. In some embodiments, such a collimator includes two members, with one of the members exhibiting channels and the other of the members exhibiting corresponding protrusions. The members are oriented so that the protrusions are received within the channels to form collimator apertures that are configured for enabling passage of X-rays. In some embodiments, the members are formed of tungsten, on which small surface features are conventionally considered difficult to form.

Figure 1:
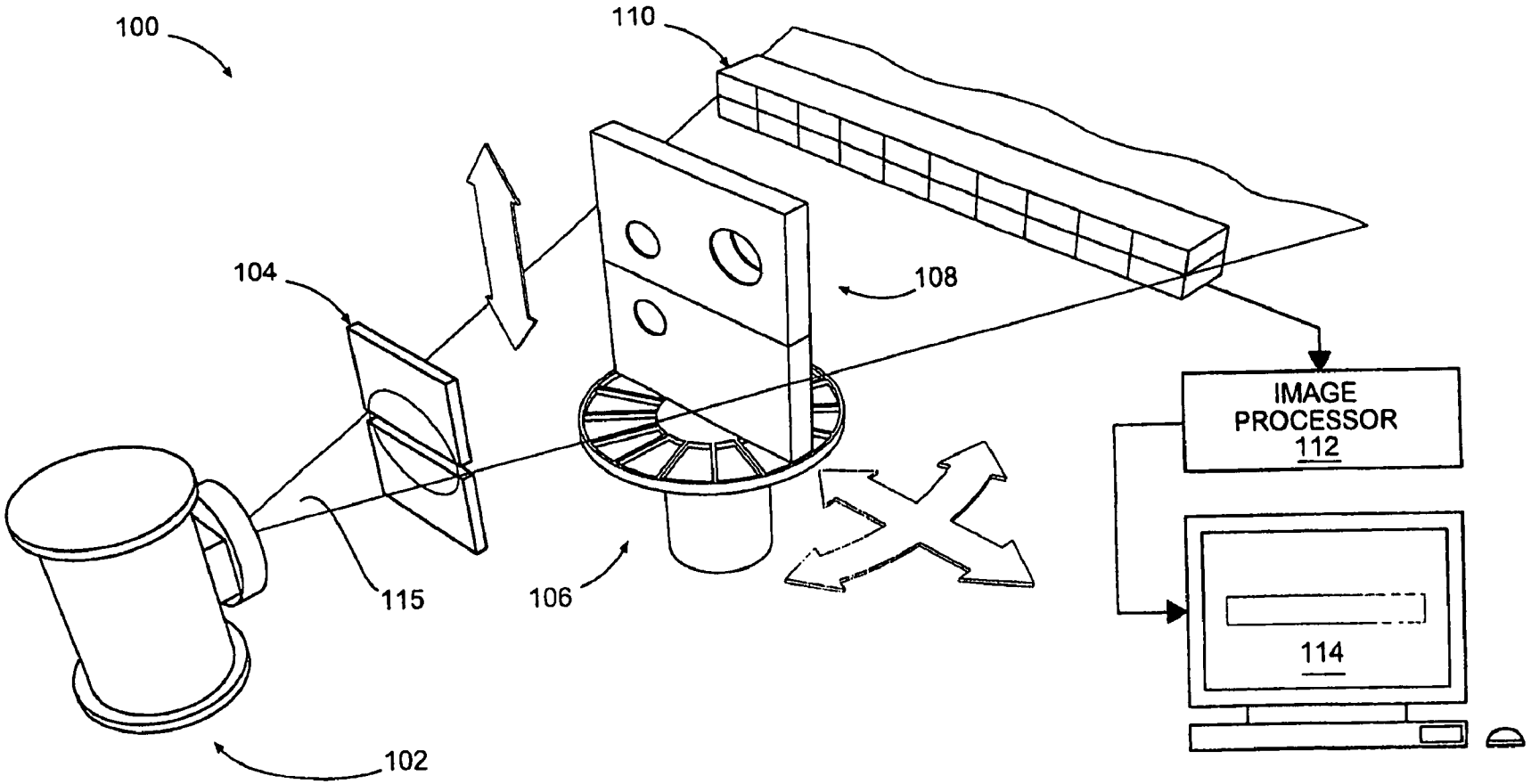
FIG. 1 is a schematic diagram depicting an exemplary embodiment of a system involving an X-ray collimator.

FIG. 1 is a schematic diagram depicting an exemplary embodiment of a system involving an X-ray collimator. As shown in FIG. 1, system 100 includes an X-ray source 102, a collimator 104, a turntable 106 on which a target 108 is positioned, a detector array 110, an image processor 112, and a display/analysis system 114. In operation, X-ray source 102 (e.g., a point source) is operative to emit X-rays. In this embodiment, the X-rays are emitted as a fan-shaped beam 115.

Collimator 104 is located downstream of source 102 and comprises a body formed of X-ray absorbing materials. In the embodiment of FIG. 1, tungsten is used although, in other embodiments, various other materials can be used such as brass or lead, for example. Details about an exemplary embodiment of a collimator will be described later with respect to FIG. 2.

Turntable 106 is a representative apparatus used for positioning a target, in this case, target 108. In operation, turntable 106 is movable to expose various portions of the target to the X-rays emitted by source 102. In this embodiment, turntable can be used to rotate the target both clockwise and counterclockwise, as well as to raise and lower the target. Altering of a horizontal position of the target in this embodiment is accomplished to expose different heights (e.g., horizontal planes) of the target to the fan-shaped beam. Notably, the elevation of the beam is fixed in this embodiment.

Detector array 110 is positioned downstream of the turntable. The detector array is operative to output signals corresponding to an amount of X-rays detected. In this embodiment, the array is a linear array, although various other configurations can be used in other embodiments.

Image processor 112 receives information corresponding to the amount of X-rays detected by the detector array and uses the information to compute image data corresponding to the target. The image data is provided to display/analysis system 114 to enable user interaction with the information acquired by the detector array.

Figure 2:
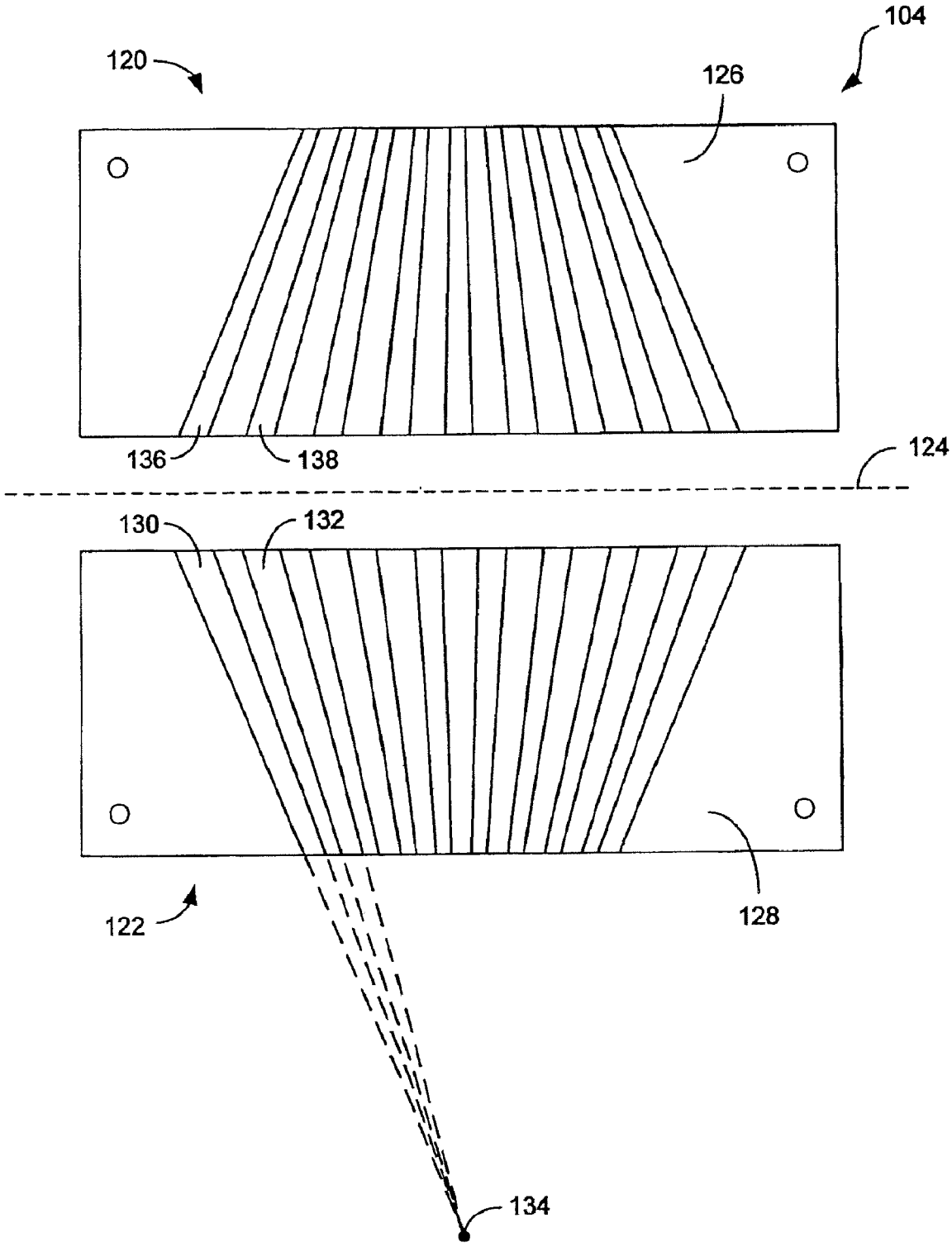
FIG. 2 is a schematic diagram depicting one embodiment of the X-ray collimator of FIG. 1, showing detail of the collimator members.

FIG. 2 is a schematic diagram depicting collimator 104 of FIG. 1, showing detail of the collimator members. In particular, collimator 104 includes members (e.g., plates) 120, 122, with the members being separated in FIG. 2 by rotating member 120 about axis 124 to expose the sides of the members that normally contact each other when assembled. Specifically, when so assembled, side 126 of member 120 contacts side 128 of member 122.

Side 128 of member 122 incorporates a set of channels (e.g., channels 130, 132) that extend radially outwardly from a center 134, which is located at a point outside the periphery of member 122. Center 134 corresponds to a location at which the X-ray source 102 is to be positioned during operation. In contrast, side 126 of member 120 incorporates a set of protrusions (e.g., protrusions 136, 138) that are oriented so that each of the protrusions can be received by a corresponding one of the channels when the members are assembled. By way of example, in the assembled configuration, protrusion 136 extends into channel 130, and protrusion 138 extends into channel 132.

Figure 3:
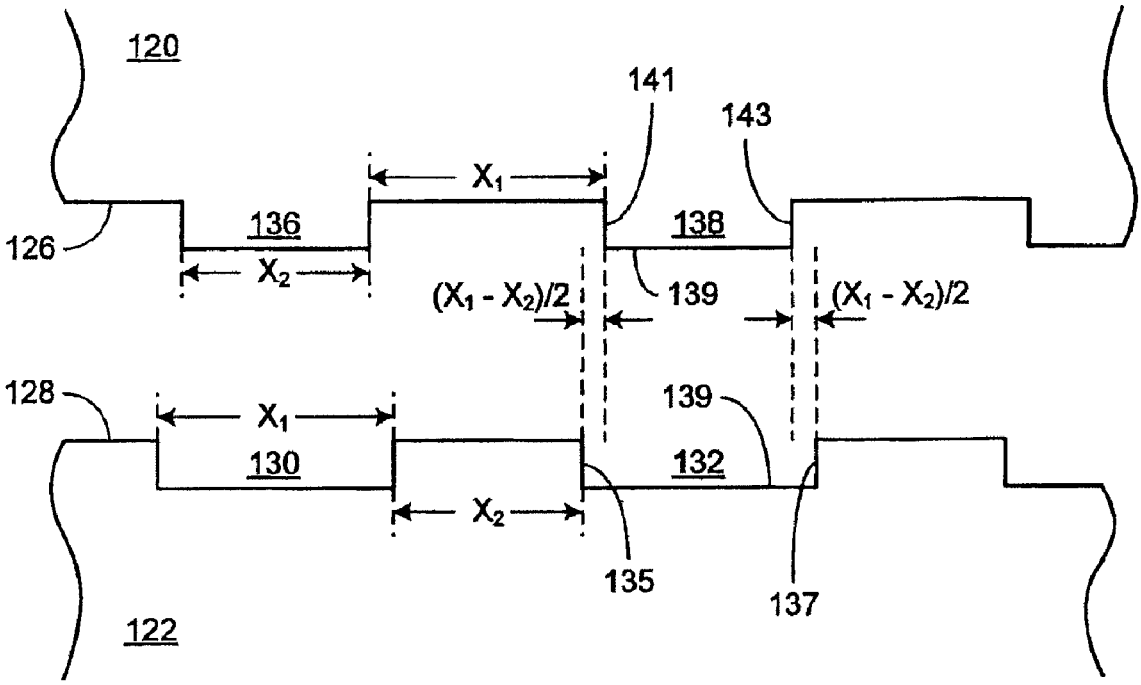
FIG. 3 is a schematic diagram depicting surface detail of the collimator members of an embodiment of an X-ray collimator.
Figure 4:
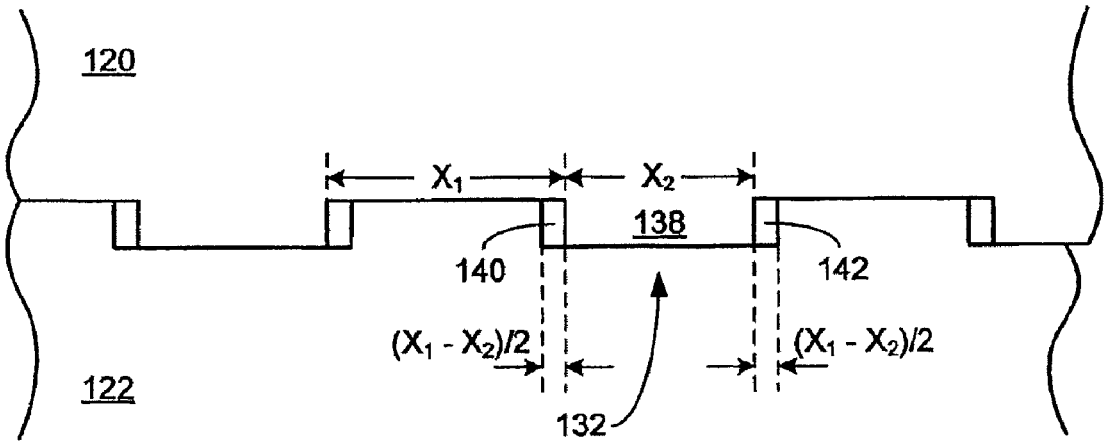
FIG. 4 is a schematic diagram depicting the collimator members of FIG. 3 in an assembled orientation.

Relative positions of the channels and protrusions is shown in greater detail in FIGS. 3 and 4, which schematically depict members 120 and 122 in unassembled and assembled configurations, respectively. As shown in FIG. 3, each of the channels is defined by a floor and sidewalls extending from the floor. For instance, channel 132 is defined by a floor 133 and sidewalls 135, 137. Each protrusion is defined by an endwall and sidewalls extending from the endwall. For instance, protrusion 138 is defined by endwall 139 and sidewalls 141, 143.

Each of the channels exhibits a width $X_1$, with the spacing between adjacent channels being $X_2$. In contrast, each of the protrusions exhibits a width $X_2$, with the spacing between adjacent protrusions being $X_1$. As shown in the assembled configuration of FIG. 4, each of the protrusions extends into a corresponding one of the channels, with the endwall of each protrusion being positioned adjacent to (e.g., contacting) a floor of a corresponding channel.

The aforementioned sizing and spacing results in the formation of collimator apertures (e.g., apertures 140, 142), each of which exhibits a width of $(X_1-X_2)/2$. By way of example, a width $X_1$ of 2.0 mm and a width $X_2$ of 1.6 mm results in collimator apertures of 0.2 mm ((2.0–1.6)/2), with the spacing between adjacent apertures being 1.8 mm (center to center). Thus, in this embodiment, the collimator apertures exhibit widths that are an order of magnitude smaller that the channels used to form the apertures.

Figure 6:
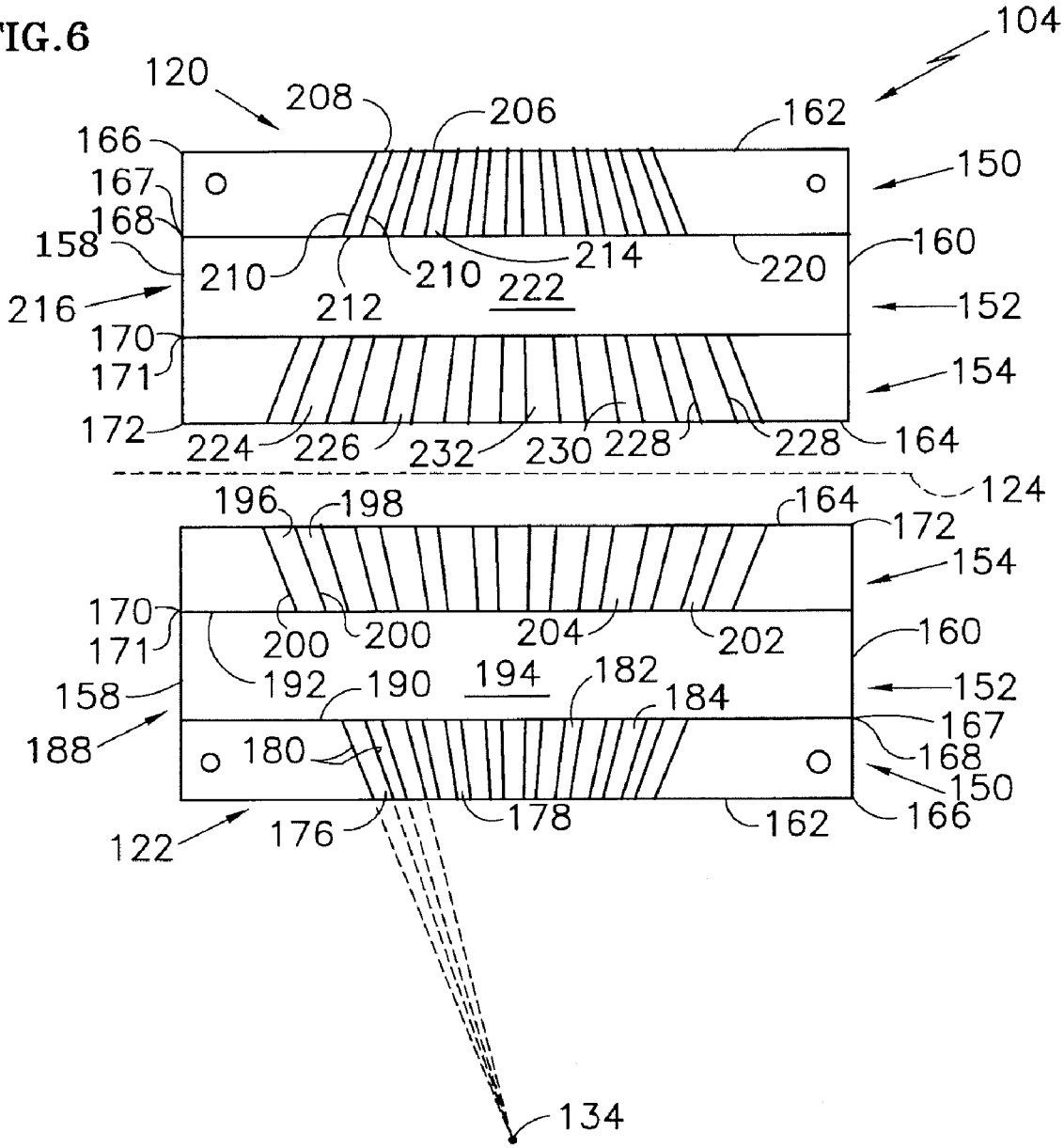
FIG. 6 is a schematic diagram depicting another embodiment of the X-ray collimator of FIG. 1, showing detail of the collimator members.
Figure 7:
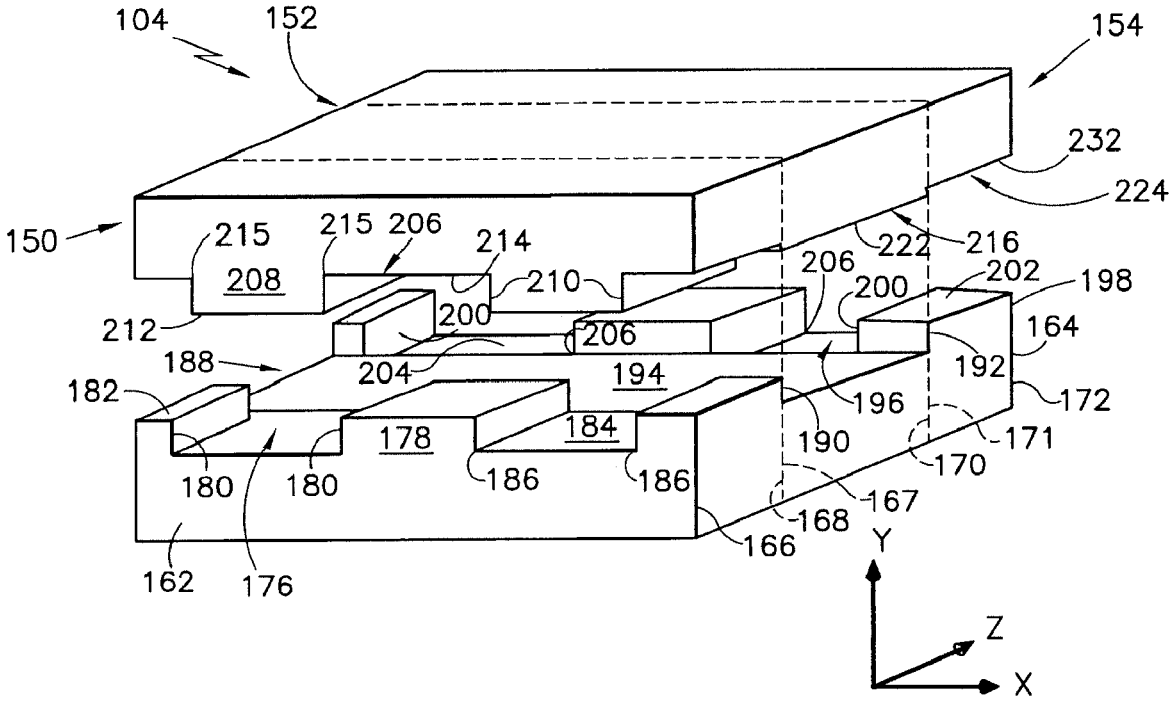
FIG. 7 is a perspective diagram depicting a portion of the X-ray collimator of FIG. 6 in a disassembled orientation.
Figure 8:
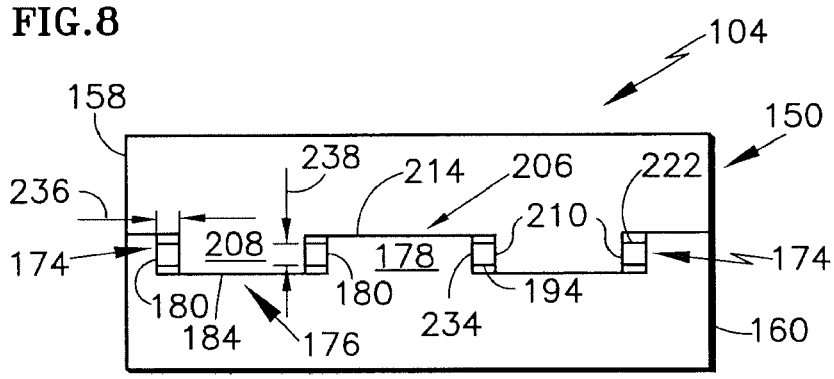
FIG. 8 is a schematic diagram depicting the collimator members of FIG. 7 in an assembled orientation.

Referring now to FIGS. 6 to 8, an alternative embodiment of the collimator 104 is shown that includes a plurality of collimator sections 150, 152, 154. The collimator extends in a first direction (e.g., along an x-axis) between two sides 158 and 160, and in a second direction (e.g., along a z-axis) between two ends 162 and 164 (e.g., a forward end and an aft end). Each collimator section 150, 152, 154 is adapted to collimate X-rays in at least one direction (e.g., a horizontal or a vertical direction). Each collimator section 150, 152, 154 extends (e.g., along the z-axis) between a first (e.g., forward) end 166, 168, 170 and a second (e.g., aft) end 167, 169, 172. In the specific embodiment in FIGS. 6 to 8, the collimator 104 sequentially includes a forward collimator section 150 (hereinafter the "forward section"), a mid collimator section 152 (hereinafter the "mid section") and an aft collimator section 154 (hereinafter the "aft section"); however, the present invention is not limited to the aforesaid configuration. The collimator 104 further includes a first member 122 (or plate), a second member 120 (or plate) and a plurality of collimator apertures 174 (see FIG. 8).

The first member 122 forms a first portion (e.g., a bottom half) of the forward section 150, the mid section 152 and the aft section 154 of the collimator 104. The forward section 150 of the first member 122 includes a plurality of channels 176 defined between a plurality of protrusions 178. The protrusions 178 and, therefore, the channels 176 extend radially outward from a center 134 between the forward end 166 and the aft end 167 of the forward section 150. Each protrusion 178 has two sidewalls 180 that extend outwardly to an endwall 182. Each channel 176 has a floor 184 that extends between inner ends 186 of adjacent sidewalls 180. The mid section 152 of the first member 122 includes a longitudinal channel 188 that extends (e.g., substantially perpendicularly to the radially outward direction of the protrusions 178) between the sides 158 and 160 of the collimator 104. The longitudinal channel 188 has two sidewalls 190 and 192 that extend inwardly to a surface 194. The aft section 154 of the first member 122 includes plurality of channels 196 defined between a plurality of protrusions 198. The protrusions 198 and, therefore, the channels 196 are respectively radially aligned with the protrusions 178 and the channels 176 in the first section 150 of the first member 122. Each protrusion 198 has two sidewalls 200 that extend outwardly to an endwall 202. Each channel 196 has a floor 204 that extends between inner ends 206 of adjacent sidewalls 200.

Referring to FIGS. 7 and 8, the first member 122 is arranged such that the surface 194 of the longitudinal channel 188 in the mid section 152 is disposed intermediately (e.g., along a y-axis) between the endwalls 182, 202 of the protrusions 178, 198 and the floors 184, 204 of the channels 176, 196 in at least one of the forward and the aft sections 150, 154. In addition, in some embodiments, the surface 194 of the longitudinal channel 188 in the mid section 152 is substantially parallel to the endwalls 182, 202 of the protrusions 178, 198 and the floors 184, 204 of the channels 176, 196 in the forward and the aft sections 150 and 154.

Referring again to FIGS. 6 to 8, the second member 120 forms a second portion (e.g., a top half) of the forward section 150, the mid section 152 and the aft section 154 of the collimator 104. The forward section 150 of the second member 120 includes a plurality of channels 206 defined between a plurality of protrusions 208. The protrusions 208 and, therefore, the channels 206 extend radially outward from a center 134 between the forward end 166 and the aft end 167 of the forward section 150. Each protrusion 208 has two sidewalls 210 that extend outwardly to an endwall 212. Each channel 206 has a floor 214 that extends between inner ends 215 of adjacent sidewalls 210. The mid section 152 of the second member 120 includes a longitudinal channel 216 that extends (e.g., substantially perpendicularly to the radially outward direction of the protrusions 208) between the sides 158 and 160 of the collimator 104. The longitudinal channel 216 has two sidewalls 218 and 220 that extend inwardly to a surface 222. The aft section 154 of the second member 120 includes plurality of channels 224 defined between a plurality of protrusions 226. The protrusions 226 and, therefore, the channels 224 are respectively radially aligned with the protrusions 208 and the channels 206 in the first section 150 of the second member 120. Each protrusion 226 has two sidewalls 228 that extend outwardly to an endwall 230. Each channel 224 has a floor 232 that extends between inner ends of adjacent sidewalls 228.

Referring to FIGS. 7 and 8, the second member 120 is arranged such that the surface 222 of the longitudinal channel 216 in the mid section 152 is disposed intermediately between the endwalls 212, 230 of the protrusions 208, 226 and the floors 214, 232 of the channels 206, 224 in at least one of the forward and the aft sections 150, 154. In addition, in some embodiments, the surface 222 of the longitudinal channel 216 in the mid section 152 is substantially parallel to the endwalls 212, 230 of the protrusions 208, 226 and the floors 214, 232 of the channels 206, 224 in the forward and the aft sections 150 and 154.

The first member 122 is mated with the second member 120. Specifically, the protrusions 178 in the forward section 150 of the first member 122 extend respectively into the channels 206 in the forward section 150 of the second member 120, thereby forming a plurality of forward passages. The forward passages can be formed on one or both sides of each respective protrusion 178. The protrusions 198 in the aft section 154 of the first member 122 extend respectively into the channels 224 in the aft section 154 of the second member 120, thereby forming a plurality of aft passages. The aft passages can be formed on one or both sides of each respective protrusion 198. Each of the forward and the aft passages has a width and a height. The width extends between the sidewall 180, 200 of one of the protrusions 178, 198 in the first member 122 and an adjacent sidewall 210, 228 of one of the protrusions 208, 226 in the second member 120. The height extends between the floor 184, 204 of one of the channels 176, 196 in the first member 122 and a floor 214, 232 of one of the channels 206, 224 in the second member 120. The longitudinal channel 188 in the mid section 152 of the first member 122 is aligned with the longitudinal channel 216 in the mid section 152 of the second member 120, thereby forming a longitudinal passage. The longitudinal passage has a width and a height. The width extends between the aft end 167 of the forward section 150 and the forward end 170 of the aft section 154. The height extends between the surface 194 of the longitudinal channel 188 in the first member 122 and the surface 222 of the longitudinal channel 216 in the second member 120. The heights of the forward and/or the aft passages are greater than the height of the longitudinal passage.

Each collimator aperture has a cross-sectional area 234 that is sized to direct a predetermined quantity of X-rays from the X-ray source 102 to one of the detectors in the detector array 110. The cross-sectional area 234 has a width 236 and a height 238. The width 236 extends between the sidewall 180, 200 of one of the protrusions 178, 198 in the first member 122 (i.e., a sidewall of one of the forward and/or the aft passages) and an adjacent sidewall 210, 228 of one of the protrusions 208, 226 in the second member 120 (i.e., an adjacent sidewall of one of the forward and/or the aft passages). The height 238 is defined between the surfaces 194, 222 of the longitudinal channels 188, 216 in the first and the second members 122, 120. Formation of the first member 122 of the collimator 104 may be accomplished by providing a blank stock of metal (e.g., tungsten) that is sized for thickness, width and length. Slots are then rough cut to provide the channels and the protrusions in the first collimator sections using a cutting tool (e.g., a 2 mm carbide cutter) to form the final depth and rough width of slots. A final pass of the cutting tool is then used to finish the vertical edges of the slots. Cutting tool offsets can be adjusted during cutting to accommodate variations attributable to cutter wear. By way of example, cutting tool offsets can be adjusted after approximately each 10 inches (254 mm) of cut in order to maintain the slot dimensions within specification. Such periodic adjustments to the cutting tool, however, typically do not account for cutting tool tip wear. Such tip wear can result in rounded corners between the floors and the sidewalls of the slots (i.e., the forward and the aft channels 176, 196). The present method can accommodate for such variations, however, by cutting an additional slot (i.e., the longitudinal channel), for example 0.75 inch (19 mm) wide, into the center of the slotted block. Specifically, as illustrated in FIG. 7, since the surface 194 of the longitudinal channel 188 is raised (e.g., along the y-axis) relative to the floors 184, 204 of the forward and the aft channels 176, 196, the cross-sectional intersection between each of the sidewalls 180, 200 of the forward and the aft channels 176, 196 and the surface 194 of the longitudinal channel 188 defines a substantially square corner. The aforesaid method can be repeated to form the second member 120 of the collimator. Upon formation of the second member 120, the collimator apertures 174 are formed by mating the two members 122, 120 together. In some embodiments, alignment features, such as dowel pins can be used to ensure proper and maintained alignment of the two halves.

Figure 5:
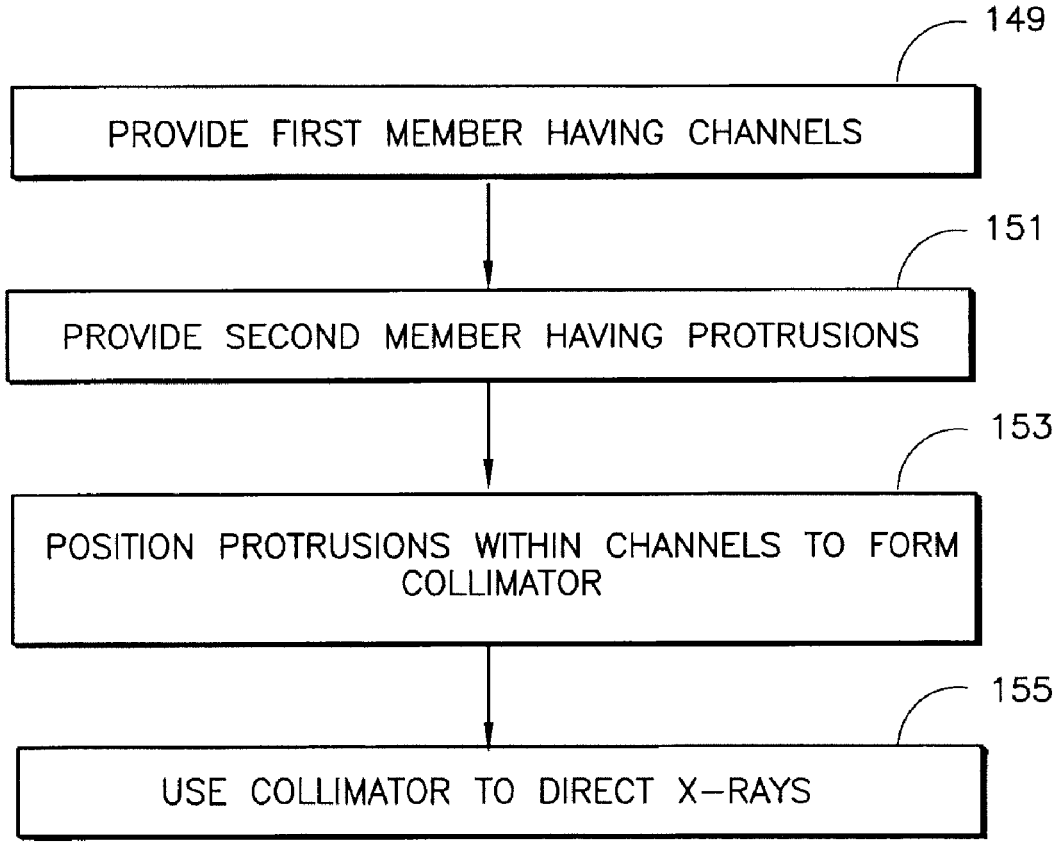
FIG. 5 is a flowchart depicting an exemplary embodiment of a method involving an X-ray collimator.

FIG. 5 is a flowchart depicting an exemplary embodiment of a method involving an X-ray collimator. As shown in FIG. 5, the method may be construed as beginning at block 149, in which a first member having channels is provided. In block 151, a second member having protrusions is provided. In block 153, the first member and the second member are oriented so that the protrusions extend into the channels to form an X-ray collimator having collimator apertures. In some embodiments, each of the channels of the first member exhibits a width that is at least approximately twice as wide as a width of each of the collimator apertures. In block 155, the collimator is used to direct X-rays at a target, such as for performing non-destructive inspection of the target to determine one or more of various characteristics. By way of example, the characteristics can include, but are not limited to, interior shape and density of the target. In some embodiments, the target can be a gas turbine engine component, such as a turbine blade.

It should be noted that a computing device can be used to implement various functionality, such as that attributable to the image processor 112 and/or display/analysis system 114 depicted in FIG. 1. In terms of hardware architecture, such a computing device can include a processor, memory, and one or more input and/or output (I/O) device interface(s) that are communicatively coupled via a local interface. The local interface can include, for example but not limited to, one or more buses and/or other wired or wireless connections. The local interface may have additional elements, which are omitted for simplicity, such as controllers, buffers (caches), drivers, repeaters, and receivers to enable communications. Further, the local interface may include address, control, and/or data connections to enable appropriate communications among the aforementioned components.

The processor may be a hardware device for executing software, particularly software stored in memory. The processor can be a custom made or commercially available processor, a central processing unit (CPU), an auxiliary processor among several processors associated with the computing device, a semiconductor based microprocessor (in the form of a microchip or chip set) or generally any device for executing software instructions.

The memory can include any one or combination of volatile memory elements (e.g., random access memory (RAM, such as DRAM, SRAM, SDRAM, VRAM, etc.)) and/or nonvolatile memory elements (e.g., ROM, hard drive, tape, CD-ROM, etc.). Moreover, the memory may incorporate electronic, magnetic, optical, and/or other types of storage media. Note that the memory can also have a distributed architecture, where various components are situated remotely from one another, but can be accessed by the processor.

The software in the memory may include one or more separate programs, each of which includes an ordered listing of executable instructions for implementing logical functions. A system component embodied as software may also be construed as a source program, executable program (object code), script, or any other entity comprising a set of instructions to be performed. When constructed as a source program, the program is translated via a compiler, assembler, interpreter, or the like, which may or may not be included within the memory.

The Input/Output devices that may be coupled to system I/O Interface(s) may include input devices, for example but not limited to, a keyboard, mouse, scanner, microphone, camera, proximity device, etc. Further, the Input/Output devices may also include output devices, for example but not limited to, a printer, display, etc. Finally, the Input/Output devices may further include devices that communicate both as inputs and outputs, for instance but not limited to, a modulator/demodulator (modem; for accessing another device, system, or network), a radio frequency (RF) or other transceiver, a telephonic interface, a bridge, a router, etc.

When the computing device is in operation, the processor can be configured to execute software stored within the memory, to communicate data to and from the memory, and to generally control operations of the computing device pursuant to the software. Software in memory, in whole or in part, is read by the processor, perhaps buffered within the processor, and then executed.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. By way of example, although channels are depicted as being associated with one member of a collimator while protrusions are depicted as being associated with another, some embodiments can include combinations of channels and protrusions one each member. All such modifications and variations are intended to be included herein within the scope of this disclosure and protected by the accompanying claims.

The invention claimed is:

1. An X-ray collimator, comprising:

a first collimator section including a plurality of passages, each passage extending between first and second surfaces;

a second collimator section including a longitudinal passage extending between first and second surfaces; and a plurality of collimator apertures, wherein each collimator aperture is respectively defined in a first direction between the first and the second surfaces of a respective one of the passages in the first collimator section, and wherein each collimator aperture is respectively defined in a second direction between the first and the second surfaces of the passage in the second collimator section.

2. The collimator of claim 1, further comprising a first member and a second member, which first member includes a first portion of the first and the second collimator sections, and which second member include a second portion of the first and the second collimator sections.

3. The collimator of claim 2, wherein:

the first member further includes a plurality of channels disposed in the first collimator section thereof, and the first surface of the longitudinal passage, wherein each channel includes the first surface of a respective one of the passages; and the second member further includes a plurality of protrusions disposed in the first collimator section thereof, and the second surface of the longitudinal passage, which protrusions respectively extend into the channels in the first member, wherein each protrusion includes the second surface of a respective one of the passages.

4. The collimator of claim 1, further comprising a third collimator section that includes a plurality of passages, each passage extending between first and second surfaces, wherein each collimator aperture is further defined in the first direction between the first and the second surfaces of a respective one of the passages in the third collimator section, and wherein the second collimator section is disposed between the first and the third collimator sections.

5. The collimator of claim 4, further comprising a first member and a second member, which first member includes a first portion of the first, the second and the third collimator sections, and which second member includes a second portion of the first, the second and the third collimator sections.

6. The collimator of claim 5, wherein:

the first member further includes a plurality of channels disposed in the first collimator section thereof, a plurality of channels disposed in the third collimator section thereof, and the first surface of the longitudinal passage, wherein each channel in the first collimator section includes the first surface of a respective one of the passages in the first collimator section, and wherein each channel in the third collimator section includes the first surface of a respective one of the passages in the third collimator section; and the second member further includes a plurality of protrusions disposed in the first collimator section thereof, a plurality of protrusions disposed in the third collimator section thereof, and the second surface of the longitudinal passage, wherein each protrusion in the first collimator section includes the second surface of a respective one of the passages in the first collimator section, wherein each protrusion in the third collimator section includes the second surface of a respective one of the passages in the third collimator section, and wherein the protrusions respectively extend into the channels in the first member.

7. The collimator of claim 6, wherein:

the first member further includes a longitudinal channel disposed in the second collimator section thereof, which longitudinal channel has sidewalls extending outwardly from the first surface of the longitudinal passage in the second collimator section of the first member; and the second member further includes a longitudinal channel disposed in the second collimator section thereof, which longitudinal channel has sidewalls extending outwardly from the second surface of the longitudinal passage of the second collimator section of the second member.

8. The collimator of claim 1, wherein each of the first passages is radially aligned with a center located outside a periphery of the collimator.

9. An X-ray collimator, comprising:

a first member including first and second collimator sections, which first collimator section includes a plurality of channels, each channel having a first channel sidewall, and which second collimator section includes a surface;

a second member mated with the first member, and including first and second collimator sections, which first collimator section includes a plurality of protrusions respectively extending into the channels, each protrusion having a first protrusion sidewall, and which second collimator section includes a surface; and a plurality of collimator apertures, each collimator aperture respectively defined in a first direction between one of the first channel sidewalls and one of the first protrusion sidewalls, and each collimator aperture defined in a second direction between the second collimator section surfaces of the first and the second members.

10. The collimator of claim 9, wherein:

the first member further includes a third collimator section that includes a plurality of channels, each channel having a first channel sidewall, wherein the second collimator section is disposed between the first and the third collimator sections; and the second member further includes a third collimator section that includes a plurality of protrusions, each protrusion respectively extending into the channels in the third collimator section of the first member, each protrusion having a first protrusion sidewall, wherein the second collimator section is disposed between the first and the third collimator sections.

11. The collimator of claim 9, wherein each of the channels and each of the protrusions is radially aligned with a center located outside respective peripheries of the first member and the second member.

12. An X-ray system, comprising:

an X-ray source; and an X-ray collimator comprising:

a first collimator section including a plurality of passages, each passage extending between first and second surfaces;

a second collimator section including a longitudinal passage extending between first and second surfaces; and a plurality of collimator apertures, wherein each collimator aperture is respectively defined in a first direction between the first and the second surfaces of a respective one of the passages in the first collimator section, and wherein each collimator aperture is respectively defined in a second direction between the first and the second surfaces of the passage in the second collimator section.

13. The system of claim 12, further comprising a first member and a second member, which first member includes a first portion of the first and the second collimator sections, and which second member includes a second portion of the first and the second collimator sections.

14. The system of claim 13, wherein:

the first member further includes a plurality of channels disposed in the first collimator section thereof, and the first surface of the longitudinal passage, wherein each channel includes the first surface of a respective one of the passages; and the second member further includes a plurality of protrusions disposed in the first collimator section thereof, and the second surface of the longitudinal passage, which protrusions respectively extend into the channels in the first member, wherein each protrusion includes the second surface of a respective one of the passages.

* * * * *